US005188386A

United States Patent [19]

Schweizer

[11] Patent Number: 5,188,386

[45] Date of Patent: Feb. 23, 1993

[54] BINDING MOUNTING APPARATUS

[76] Inventor: Russell J. Schweizer, 954 W. Grace, Chicago, Ill. 60613

[21] Appl. No.: 842,881

[22] Filed: Feb. 26, 1992

[51] Int. Cl.[5] ..... A63C 5/03

[52] U.S. Cl. ..... 280/607; 280/633; 280/636; 280/14.2

[58] Field of Search ..... 280/14.2, 633, 636, 280/617, 618, 607

[56] References Cited

U.S. PATENT DOCUMENTS

| | | | |
|---|---|---|---|
| 2,955,300 | 10/1960 | Hedlund et al. | 280/618 |
| 3,917,298 | 11/1975 | Haff | 280/607 |
| 5,028,068 | 7/1991 | Donovan | 280/14.2 |

FOREIGN PATENT DOCUMENTS

| | | | |
|---|---|---|---|
| 0351298 | 1/1990 | European Pat. Off. | 280/14.2 |
| 0398794 | 11/1990 | European Pat. Off. | 280/14.2 |

*Primary Examiner*—David M. Mitchell

*Attorney, Agent, or Firm*—Speckman & Pauley

[57] ABSTRACT

A binding mounting apparatus having a baseplate which is mounted to a board surface of a snowboard or the like. A pivot stem with an enlarged head portion is secured to the baseplate. A mounting plate has at least one mounting through hole and a stem through hole. The pivot stem is positioned within the stem through hole. Such stem through hole is sized large enough for the pivot stem to fit within the stem through hole and small enough for the enlarged head to prevent the mounting plate from moving beyond or traveling over the enlarged head portion when the apparatus is tightened. A riser ring is positioned about the mounting plate. A face plate is mounted on the riser ring. The face plate has at least one face plate through hole which can be aligned with a corresponding mounting through hole so that the binding mounting apparatus can be tightened with respect to the board surface and so that all elements of such apparatus can be tightened with respect to each other.

16 Claims, 6 Drawing Sheets

BINDING MOUNTING APPARATUS

BACKGROUND OF THE INVENTION

1. Field of the Invention

This invention relates to a binding mounting apparatus which is used to mount a binding plate at various angles with respect to a board surface upon which the apparatus of this invention is mounted.

2. Description of Prior Art

Conventional mounting apparatuses are used to secure a conventional binding or a conventional binding plate with respect to a board surface. Such conventional bindings are used to mount a ski boot, for example, with respect to a snowboard.

Snowboards are used for recreational sport purposes on snow-covered downhill slopes. A person riding a snowboard positions his or her feet in various positions with respect to the snowboard. It is often desirable to fix the feet with respect to each other and with respect to the snowboard in many different positions, depending upon the particular purpose or mode of snowboard skiing and depending upon the particular terrain of the downhill slope.

Conventional binding mounting apparatuses are very cumbersome to adjust and they elevate the snowboard user higher than that distance which is most desirable. Conventional binding mounting apparatuses require a relatively long time to adjust the bindings into different positions. Thus, there is a need for a binding mounting apparatus that provides quick adjustment of the bindings with respect to each other and with respect to the board surface of the snowboard.

SUMMARY OF THE INVENTION

It is one object of this invention to provide a binding mounting apparatus which can be rotated into various positions with respect to the board surface of a snowboard or the like.

It is another object of this invention to provide a binding mounting apparatus that allows for adjustment of the pitch and roll angles of a conventional binding plate, with respect to the board surface.

It is still another object of this invention to provide a binding mounting apparatus that maintains the mounted binding plate relatively close to the board surface.

The above and other objects of this invention are accomplished with a binding mounting apparatus that includes a baseplate which is mounted to the board surface. According to one preferred embodiment of this invention, a pivot stem with an enlarged upper head portion is secured with respect to the baseplate. The pivot stem is preferably secured to the baseplate by external threads on the pivot stem engaging with internal threads of a collar which is either mounted to the baseplate or an integral part of the baseplate.

A mounting plate with at least one mounting through hole and a stem through hole is positioned so that the pivot stem extends within the stem through hole of the mounting plate. The stem through hole is preferably sized large enough for the pivot stem to fit within the stem through hole and small enough so that the mounting plate cannot work its way beyond the enlarged head of the pivot stem. Such arrangement allows the mounting plate to both rotate about the pivot stem and assume various angular positions with respect to the board surface.

A riser ring is positioned so that the mounting plate fits within the riser ring leaving clearance tolerances which enable the mounting plate to be moved into various positions. According to one preferred embodiment of this invention, at least two riser rings are stacked on top of each other. Each riser ring preferably has an overall wedge shape so that when the riser rings are positioned or stacked on top of each other, they can be rotated with respect to each other to form various angles between a face plate and the board surface.

The face plate of this invention has at least one face plate through hole, each of which can be aligned with a corresponding mounting through hole. Threaded screws are preferably used to secure the binding plate against the face plate by inserting such threaded screws through the face plate through holes and the mounting through holes. According to one preferred embodiment of this invention, an internally threaded collar or nut is attached to an underside or lower surface of the mounting plate so that the threaded screws can be matingly engaged within such internally threaded collars. Other means for securing the binding plate with respect to the mounting plate are apparent to those skilled in the art.

By rotating the pivot stem into an internally threaded collar which is mounted to the baseplate, the mounting plate is drawn toward the board surface of the snowboard. By using the threaded screws to attach the binding plate to the mounting plate, the mounting plate is drawn in an upward direction toward the binding plate. By tightening the pivot stem and the threaded screws, the riser rings tighten against the board surface and the other elements of this invention tighten with respect to each other.

According to this invention, the face plate can be adjusted at many various angles, depending upon an overall wedge shape of each riser ring. Furthermore, the mounting plate can be rotated into any desirable position with respect to the board surface. By rotating the riser rings with respect to each other, the mounting plate and thus the face plate can be adjusted in any angular position with respect to the board surface. Both the rotational and angular adjustments of the binding mounting apparatus according to this invention can be accomplished relatively quickly when compared to conventional binding mounting apparatuses.

DETAILED DESCRIPTION OF PREFERRED EMBODIMENTS

Figure 1:
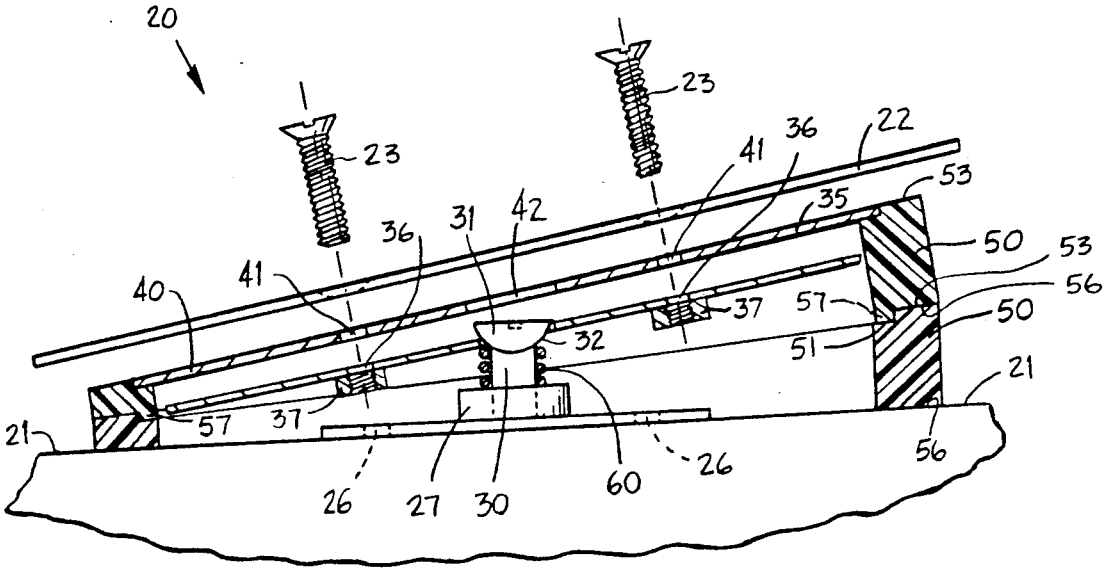
FIG. 1 is a partial sectional view of a binding mounting apparatus, according to one preferred embodiment of this invention.

Referring to FIG. 1, one preferred embodiment of binding mounting apparatus 20 is shown in a partial cross-sectional view. Binding plate 22 is a typical plate found on many conventional boot bindings or other bindings. According to the preferred embodiment shown in FIG. 1, binding mounting apparatus 20 comprises baseplate 25. Baseplate 25 is mounted to board surface 21. As shown in FIG. 1, baseplate 25 is preferably mounted to board surface 21 with a plurality of screws that are inserted within through holes 26 and into board surface 21. However, it is apparent that other mount means can be used to mount baseplate 25 with respect to board surface 21, such as suitable adhesives, or by forming baseplate 25 as integral part of board surface 21. It is apparent that board surface 21 is a generally planar, sometimes slightly curved, surface of a snowboard, ski or the like.

At its upper end pivot stem 30 diverges into enlarged head portion 31. As shown in the preferred embodiment of FIG. 1, the underside of enlarged head portion 31 forms cupped surface 32. It is apparent that any suitably shaped diverging portion can be used to form enlarged head portion 31, such as the preferred embodiment shown in FIG. 4. Cupped surface 32 is preferred since it is easier for mounting plate 35 to rotate about such cupped surface 22, as will be discussed later in this specification.

Figure 2:
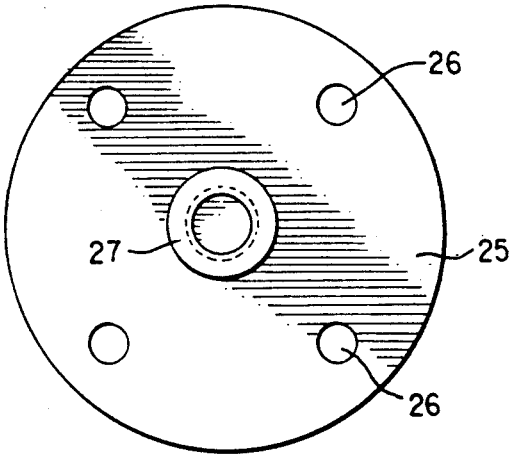
FIG. 2 is a plan view of a baseplate according to one preferred embodiment of this invention.
Figure 4:
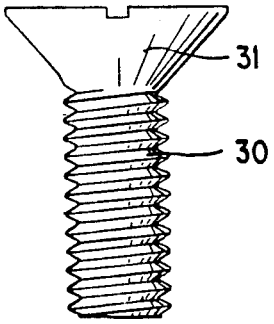
FIG. 4 is a front view of a pivot stem, according to one preferred embodiment of this invention.
Figure 3:
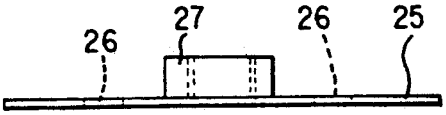
FIG. 3 is a side view of the baseplate as shown in FIG. 2.

Securement means are used to secure pivot stem 30 to baseplate 25. In the preferred embodiment shown in FIG. 1, collar 27 many also have an integrally threaded bore. As shown in FIG. 4, pivot stem 30 has an externally threaded stem portion. Such externally threaded stem portion mates with the internally threaded portion of collar 27 and thus secures pivot stem 30 with respect to baseplate 25. FIGS. 2 and 3 show the internally threaded collar 27. It is apparent that other securement means, such as welding, adhesives and the like can be used secure pivot stem 30 with respect to baseplate 25. However, the preferred embodiment shown in FIG. 1 with the threaded connection enables easy assembly and disassembly of pivot stem 30 with respect to baseplate 25.

Figure 5:
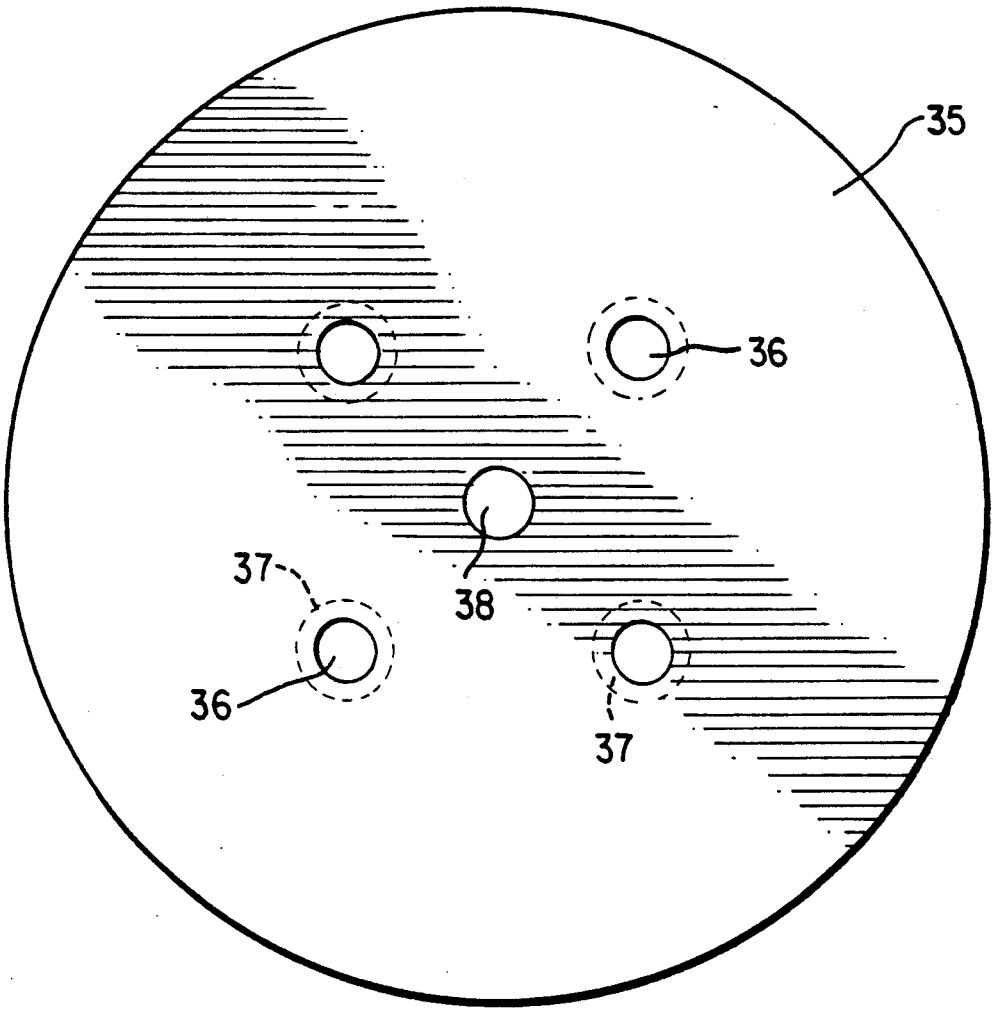
FIG. 5 is a plan view of a mounting plate, according to one preferred embodiment of this invention.
Figure 6:
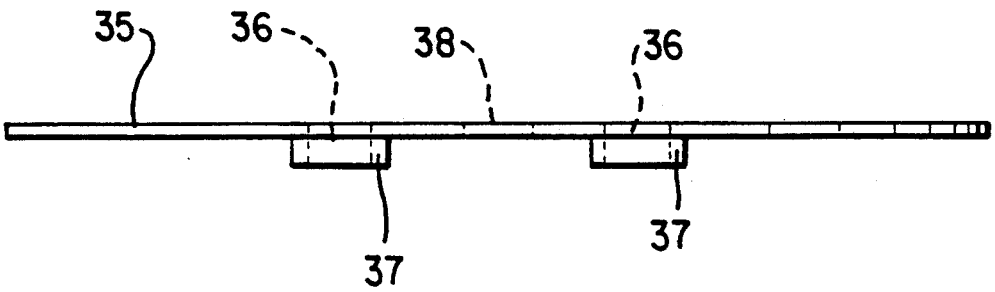
FIG. 6 is a side view of the mounting plate as shown in FIG. 5.

As shown in FIGS. 5 and 6, mounting plate 35 has at least one through hole 36 and stem through hole 38. As shown in FIG. 1, pivot stem 30 is positioned within stem through hole 38 of mounting plate 35. Stem through hole 38 is sized large enough for pivot stem 30 to fit within stem through hole 38. Stem through hole 38 is also sized small enough so that when mounting plate 35 is drawn or tightened in an upward direction, relative to the position as shown in FIG. 1, enlarged head portion 31 of pivot stem 30 prevents mounting plate 35 from moving or extending upward beyond enlarged head portion 31. By maintaining a bearing surface between mounting plate 35 and enlarged head portion 31, mounting plate 35 can be rotated with respect to pivot stem 30 and its angular position can be adjusted with respect to board surface 21. It is apparent that stem through hole 38 need not be circular; however, such arrangement is preferred to minimize wear on mounting plate 35. Mounting plate 35 can also have a cupped edge about stem through hole 38 for providing a better bearing surface between mounting plate 35 and cupped surface 32.

It is apparent that mounting plate 35 can have an overall circular shape, as shown in FIG. 5, or can have any other suitable shape that, depending upon the relative positions of through holes 36. In another preferred embodiment according to this invention, collar 37 is secured to an underside or lower surface of mounting plate 35, as shown in FIG. 1. In such preferred embodiment, collar 37 has an internally threaded bore which can be used to engage externally threaded screw 23 that extends through appropriately sized bores within binding plate 22, within through hole 41 of face plate 40, and within through holes 36 of mounting plate 35. Binding plate 22 is mounted adjacent to the outer surface of face plate 40. It is also apparent that collar 37 can be positioned on the upper surface of mounting plate 35. It is further apparent that collar 37 can be replaced by a conventional nut. In another preferred embodiment according to this invention, through hole 36 is tapped with threads for accommodating threaded screw 23. It is apparent that any other means for attaching binding plate 22 with respect to mounting plate 35 can be used. However, the preferred embodiment shown in FIG. 1 facilitates quick and easy connection and disconnection of the apparatus of this invention.

Figure 7:
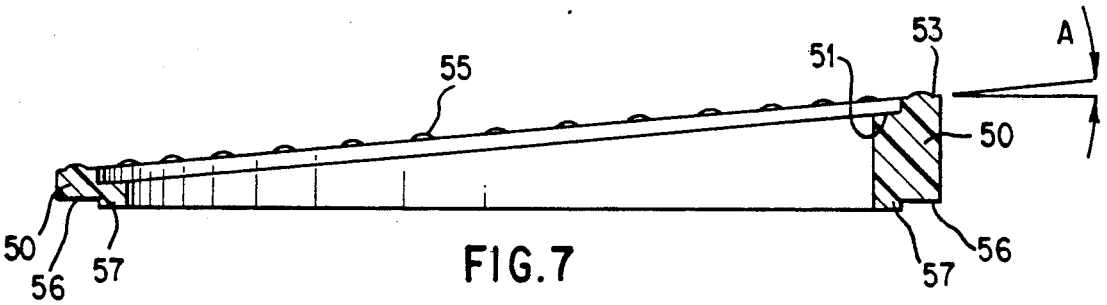
FIG. 7 is a sectional view of a riser ring, according to one preferred embodiment of this invention.
Figure 8:
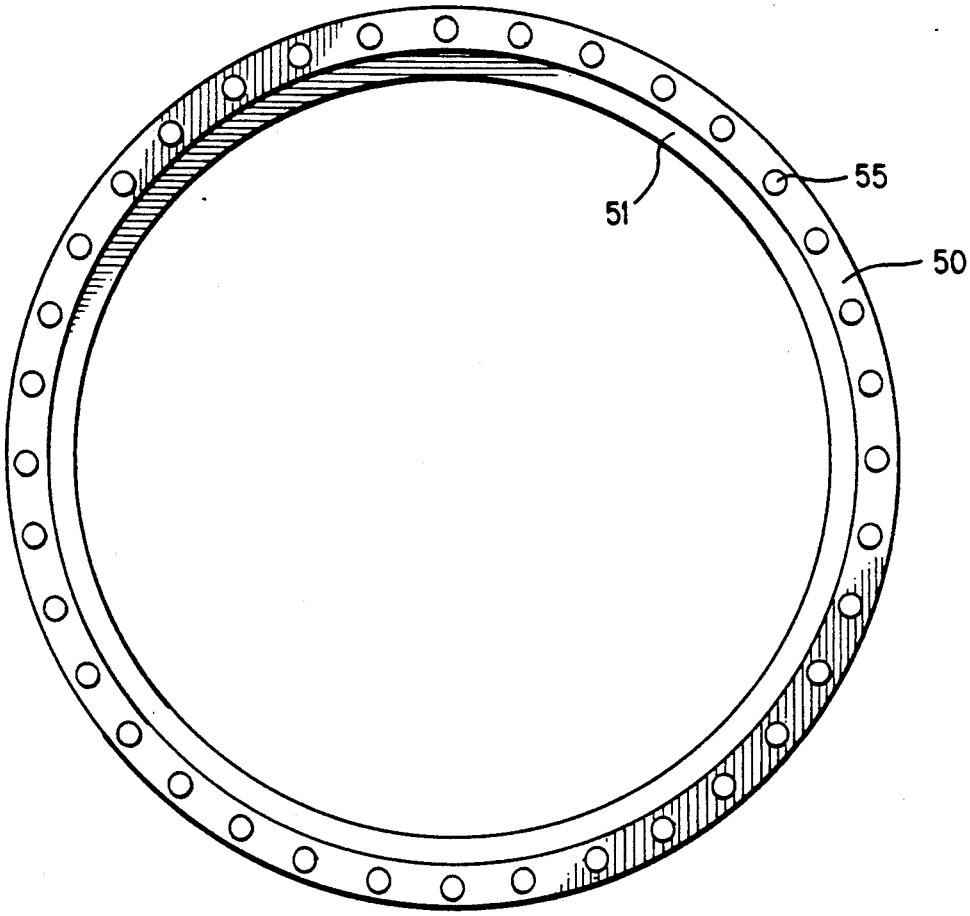
FIG. 8 is a plan view of the riser ring, as shown in FIG. 7.
Figure 9:
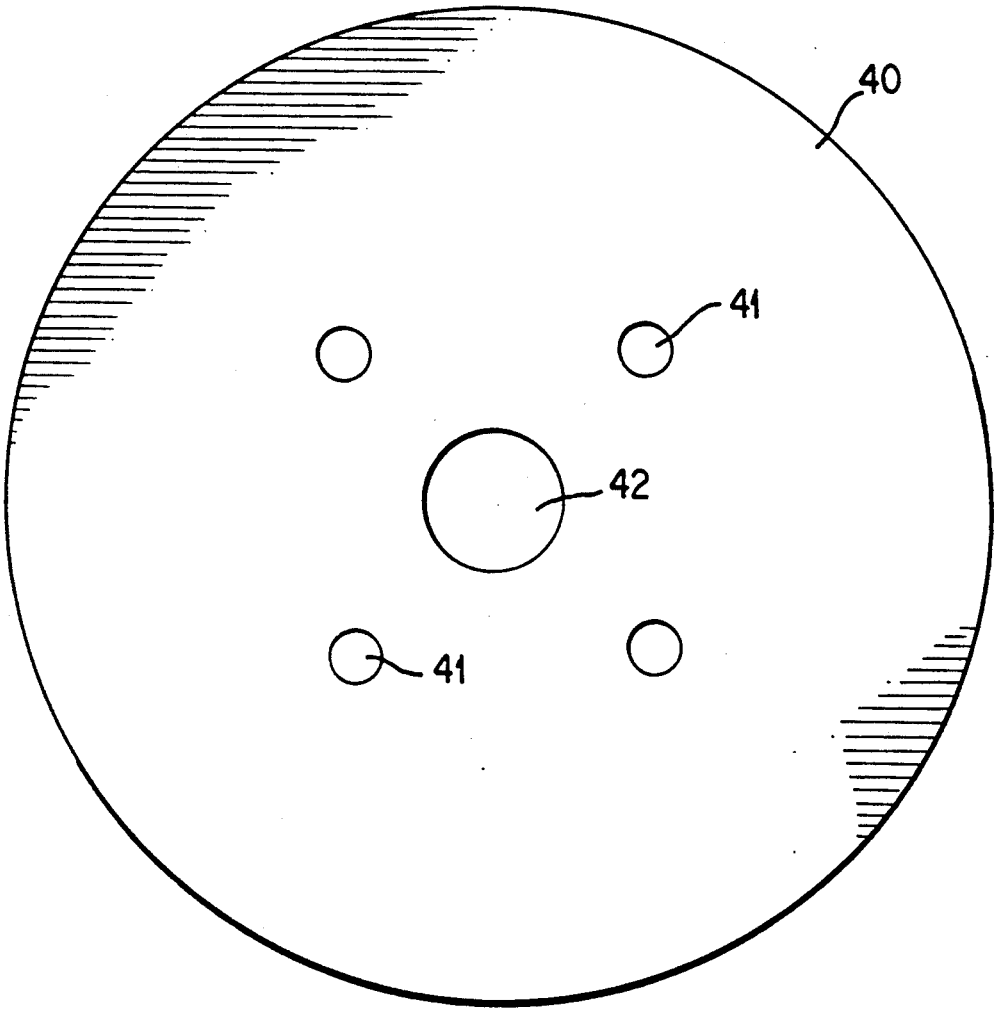
FIG. 9 is a plan view of a face plate, according to one preferred embodiment of this invention.

Although FIG. 1 shows two riser rings 50 stacked on top of each other, each shown in detail in FIGS. 7 and 8, it is apparent that one or more than two riser rings 50 can be positioned on top of each other to achieve a desired angular variation of face plate 40 with respect to board surface 21. According to one preferred embodiment of this invention, face plate 40 is mounted on riser ring 50. As shown in FIG. 1, face plate 40 fits within peripheral edge groove 51 of riser ring 50. Face plate 40 can have an overall shape as shown in FIG. 9, or can have any other overall suitable shape, as long as through holes 41 are positioned as desired. Face plate 40 preferably has as many through holes 41 as mounting plate 35 has through holes 36. Furthermore, through holes 41 preferably can be aligned with through holes 36 so that threaded screw 23 can be simultaneously positioned within binding plate 22, face plate 40, and mounting plate 35. By tightening threaded screws 23, binding plate 22 and face plate 40 are both drawn toward mounting plate 35. The net effect of such forces along with the forces that draw mounting plate 35 toward board surface 21, due to tightened pivot stem 30, is that the overall apparatus of this invention tightens itself against board surface 21 and thus locks face plate 40 in its desired position. Mounting plate 35 is positioned within riser ring 50, as shown in FIG. 1.

As shown in FIGS. 1 and 9, access through hole 42 of face plate 40 is used to provide access to enlarged head portion 31. Enlarged head portion 31 preferably has either a slot for a standard screwdriver or two slots for a Phillips screwdriver, or any other groove configuration to accommodate a special tool. It is apparent that access through hole 42 can have a circular shape or any other suitable shape that allows access to enlarged head portion 31. Face plate 40 does not necessarily require access through hole 42, but such arrangement is preferred.

Figure 10:
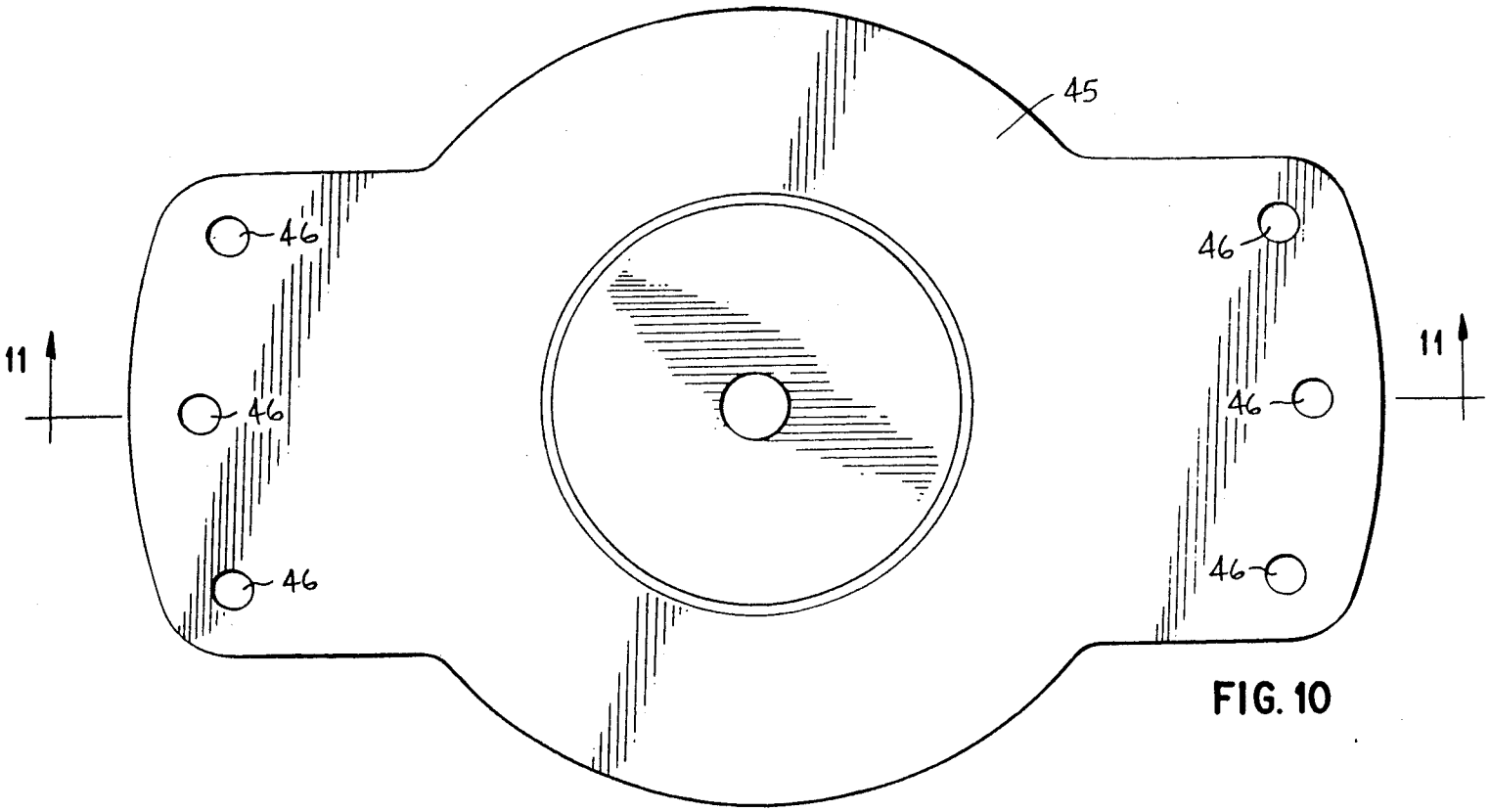
FIG. 10 is plan view of an adapter plate according to one preferred embodiment of this invention.
Figure 11:
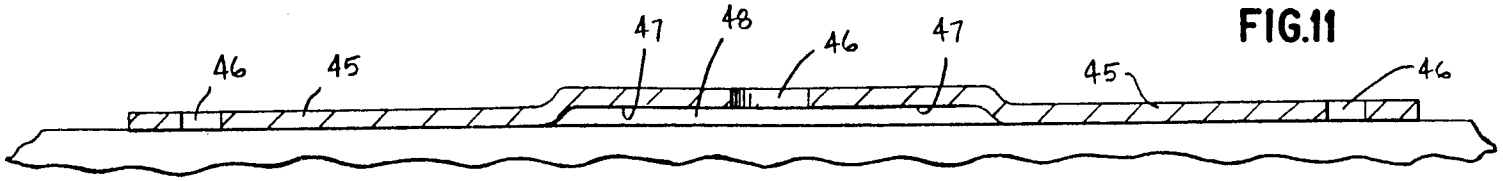
FIG. 11 is a cross-sectional view, taken along line 11—11. of the adapter plate, as shown in FIG. 10.

FIGS. 10 and 11 show adapter plate 45, according to one preferred embodiment of this invention. Adapter plate 45 has at least one through hole 46 which is used to secure adapter plate 45 directly to board surface 21. Recessed area 47 is shown in FIG. 11 and is formed between adapter plate 45 and board surface 21. Recessed area 47 preferably has an overall shape that corresponds to the overall shape of baseplate 25. Recessed area 47 forms accommodating space 48 in which baseplate 25 can be mounted. The thickness of recessed area 47 is preferably less than the thickness of baseplate 25 so that when adapter plate 45 is tightened against board surface 21, adapter plate 45 forcefully contacts baseplate 25 to secure it in a fixed position with respect to board surface 21 and adapter plate 45. Although such embodiment is preferred, it is also apparent that recessed area 47 can have a greater thickness than the thickness of baseplate 25, in which case baseplate 25 would simply rotate until it is tightened by pivot stem 30 being rotated within collar 27.

As shown in FIG. 1, coil spring 60 is preferably mounted about pivot stem 30 between baseplate 25 and mounting plate 35. Such coil spring 60 normally forces mounting plate 35 away from baseplate 25 and collar 27 so that the assembly and disassembly process of this invention is more convenient.

Each riser ring 50 preferably has an overall wedge shape, as is best shown in FIG. 7. Upper face surface 53 preferably has frictional means for providing increased friction at an upper faced surface of riser ring 50. Such frictional means are shown as relatively small crush bumps 55 positioned about the periphery of riser ring 50. It is apparent that such frictional means may also comprise a roughened surface on at least a portion of upper face surface 53. The overall wedge shape of each riser ring 50 preferably forms an angle "A" of approximately 1° to approximately 45° between upper face surface 53 and lower face surface 56. The preferred angle "A", as shown in FIG. 7, is approximately 5°. By stacking two or more riser rings 50 on top of each other, as shown in FIG. 1, each riser ring 50 can be rotated with respect to each other to achieve an overall desired angle of face plate 40 with respect to board surface 21. With respect to the embodiment shown in FIG. 1, if an angle "A" is 5°, then by rotating riser rings 50 with respect to each other, any angle between 0 and 10° can be achieved. Also as shown in FIGS. 1 and 7, peripheral edge groove 51 is used to mount face plate 40 with respect to riser ring 50. Lower inner peripheral shoulder 57 which is positioned about at least a portion of lower face surface 56 of riser ring 50 is used to maintain the position of each riser ring 50 with respect to another riser ring 50, by engaging such lower inner peripheral shoulder 57 with a corresponding peripheral edge groove 51 of upper face surface 53.

Figure 12:
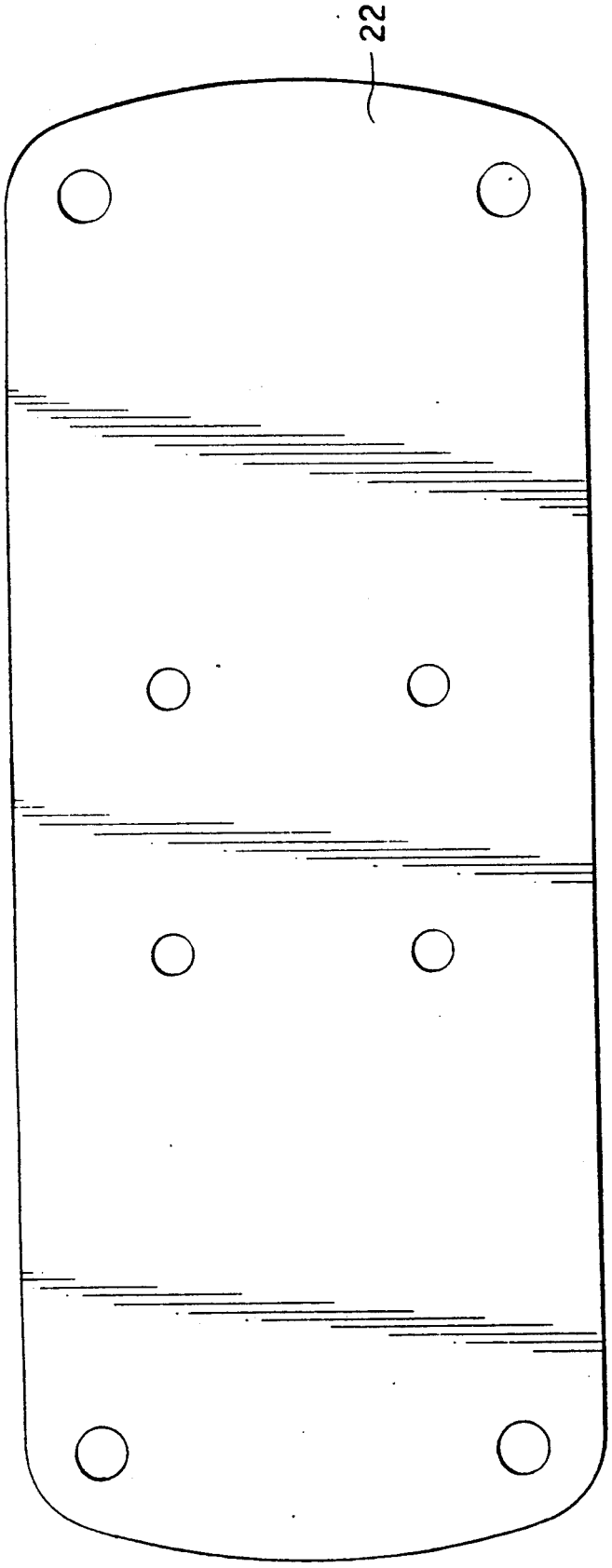
FIG. 12 is a plan view of a retrofitted binding plate, according to one preferred embodiment of this invention.
Figure 13:
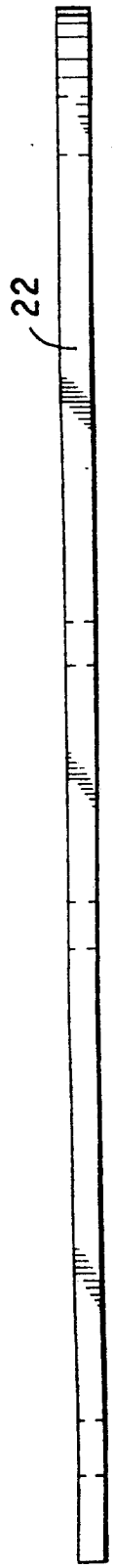
FIG. 13 is a side view of the retrofitted binding plate, as shown in FIG. 12.

FIGS. 12 and 13 show a plan view and a side view, respectively, of a retrofitted binding plate 22 that is used to accommodate many conventional bindings with the binding mounting apparatus of this invention. It is apparent that other retrofitted plates can be used to relocate specific through hole locations, depending upon the design of a conventional binding or a conventional binding plate.

Riser rings 50 are preferably constructed of a relatively hard rubber. The remaining elements of this invention are preferably constructed of metal material, but it is apparent that other suitable materials can be used.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A binding mounting apparatus comprising:

a baseplate, mount means for mounting said baseplate to a board surface, a pivot stem having an enlarged head portion,. securement means for securing said pivot stem to said baseplate;

a mounting plate having at least one mounting through hole and a stem through hole, said pivot stem positioned within said stem through hole, said stem through hole sized large enough for said pivot stem to fit within said stem through hole, said stem through hole sized small enough for said enlarged head to prevent said mounting plate from traveling over said enlarged head; and a primary riser ring, a face plate mounted on said primary riser ring, said face plate having at least one face plate through hole each alignable with each corresponding said mounting through hole, said mounting plate positioned within said primary riser ring.

2. A binding mounting apparatus according to claim 1 wherein said mount means further comprise said baseplate having a plurality of baseplate through holes.

3. A binding mounting apparatus according to claim 1 wherein said mount means further comprise: an adapter plate, said adapter plate having at least one adapter through hole, said adapter plate having a recessed area corresponding to an overall shape of said baseplate, and said recessed area forming an accommodating space between said adapter plate and the board surface for accommodating said baseplate.

4. A binding mounting apparatus according to claim 1 wherein said pivot stem diverges into said enlarged head as a cupped surface.

5. A binding mounting apparatus according to claim 1 wherein said securement means comprise an internally threaded collar secured to said baseplate, and said pivot stem having external threads matingly engageable within said internally threaded collar.

6. A binding mounting apparatus according to claim 1 further comprising an internally threaded collar secured to said mounting plate.

7. A binding mounting apparatus according to claim 6 wherein a collar through hole of said collar is aligned with a corresponding said mounting through hole.

8. A binding mounting apparatus according to claim 1 further comprising a coil spring mounted about said pivot stem between said baseplate and said mounting plate.

9. A binding mounting apparatus according to claim 1 wherein said face plate has an access through hole aligned with said enlarged head.

10. A binding mounting apparatus according to claim 1 wherein said primary riser ring further comprises a peripheral edge groove and said face plate is mounted within said peripheral edge groove.

11. A binding mounting apparatus according to claim 1 wherein said primary riser ring further comprises frictional means for providing increased friction at an upper face surface of said primary riser ring.

12. A binding mounting apparatus according to claim 1 wherein said primary riser ring has a primary overall wedge shape.

13. A binding mounting apparatus according to claim 12 wherein said primary overall wedge shape forms an angle of approximately 1° to approximately 45° between a primary upper face surface and a primary lower face surface of said primary riser ring.

14. A binding mounting apparatus according to claim 13 further comprising a secondary riser ring having a secondary overall wedge shape.

15. A binding mounting apparatus according to claim 14 wherein said secondary overall wedge shape forms an angle of approximately 1° to approximately 45° between a secondary upper face surface and a secondary lower face surface of said secondary riser ring.

16. A binding mounting apparatus according to claim 1 wherein said primary riser ring has a lower inner peripheral shoulder about at least a portion of said primary lower face surface.

* * * * *